US005462827A

United States Patent [19]

Yagi et al.

[11] Patent Number: 5,462,827

[45] Date of Patent: Oct. 31, 1995

[54] ELECTROPHOTOGRAPHIC PHOTORECEPTOR AND ELECTROPHOTOGRAPHIC PROCESS

[75] Inventors: Shigeru Yagi; Masato Ono; Taketoshi Higashi; Tsuyoshi Ohta; Yuzuru Fukuda, all of Minami Ashigara, Japan

[73] Assignee: Fuji Xerox Co., Ltd., Tokyo, Japan

[21] Appl. No.: 184,193

[22] Filed: Jan. 18, 1994

[30] Foreign Application Priority Data

Jan. 20, 1993 [JP] Japan ..... 5-023422

[51] Int. Cl.[6] ..... G03G 5/14

[52] U.S. Cl. ..... 430/65; 430/67; 430/126

[58] Field of Search ..... 430/84, 64, 66, 430/65, 67

[56] References Cited

U.S. PATENT DOCUMENTS 4,960,662 10/1990 Nishikawa et al. ..... 430/84

4,965,154 10/1990 Karakida et al. ..... 430/84

5,183,719 2/1993 Yagi et al. ..... 430/84

FOREIGN PATENT DOCUMENTS 62-8781 2/1987 Japan .

64-9625 2/1989 Japan .

1-179166 7/1989 Japan .

4-15938 3/1992 Japan .

*Primary Examiner*—John Goodrow

*Attorney, Agent, or Firm*—Oliff & Berridge

[57] ABSTRACT

A negative-charging electrophotographic photoreceptor comprising an electrically conductive support having consecutively thereon (a) a charge injection prevention layer having a thickness of from 0.15 to 10 μm, (b) a photoconductive layer, and (c) a surface layer, the charge injection prevention layer (a) comprising amorphous silicon containing at least one of a hydrogen atom and a halogen atom, and containing a nitrogen atom in an atomic ratio of from 0.01 to 0.65 to the silicon atom, the photoconductive layer (b) comprising amorphous silicon containing at least one of a hydrogen atom and a halogen atom.

8 Claims, 1 Drawing Sheet

ELECTROPHOTOGRAPHIC PHOTORECEPTOR AND ELECTROPHOTOGRAPHIC PROCESS

FIELD OF THE INVENTION

The present invention relates to an electrophotographic photoreceptor, and particularly to an electrophotographic photoreceptor having photosensitive layer comprising amorphous silicon. The present invention also relates to an electrophotographic process using the photoreceptor.

BACKGROUND OF THE INVENTION

In an electrophotographic process which has been most generally practiced at present, an amorphous selenium series photoreceptor and an organic photoreceptor are used as the photoreceptor. However, these photoreceptors are lacking in the crystallization, the mechanical characteristics, and panchromatic property.

Recently, as an electrophotographic photoreceptor, a photoreceptor having a photoconductive layer mainly composed of amorphous silicon is proposed. The photoreceptor having the photoconductive layer mainly composed of amorphous silicon is excellent in hardness, heat stability, and chemical stability, as compared with the amorphous selenium photoreceptor and the organic photoreceptor described above, and hence is expected to become a long-life photoreceptor having a high sensitivity.

Amorphous silicon is a photoconductor showing both polarities and is expected to be used as a positive-charging type photoreceptor and a negative-charging type photoreceptor for a electrophotographic photoreceptor, as described, e.g., in JP-A-1-179166 (the term "JP-A" as used herein means as "unexamined published Japanese patent application").

However, with the recent propagation of a negative-charging type organic photoreceptor, many systems using a developer for a negative-charging system have been investigated and practically used, and there occurs a problem in that the amorphous silicon photoreceptor which has hitherto been practically used as a positive-charging photoreceptor can not be applied to the negative-charging system.

JP-B-64-9625 and JP-B-64-962 (the term "JP-B" as used herein means an "examined published Japanese patent application") disclose a positive-charging or negative-charging electrophotographic photoreceptor comprising an amorphous silicon photoconductive layer having a hydrogen atom content of from 1 to 40 atomic %, and an amorphous silicon charge injection inhibition layer (interlayer) having a hydrogen atom content of from 0.25 to 35 atomic % and a nitrogen atom content of from 25 to 55 atomic %, which is provided between the amorphous silicon photoconductive layer and a substrate.

The composition of the interlayer as disclosed is shown by a-$(Si_xN_{1-x})_y$:$H_{1-7}$, and the value of x must be in the range of from 0.43 to 0.60. The ratio of N/Si of the interlayer becomes 1.32 when x is 0.43 and the ratio becomes 0.66 when x is 0.60. That is, the interlayer containing from 0.66 to 1.32 by atomic ratio of a nitrogen atom to a silicon atom is disclosed. It is also described that the thickness of the interlayer is in the range of from 30 to 1,000 Å (0.003 to 1 μm).

The function as the interlayer is to improve the charge blocking property (charge injection prevention), and the improvement of the charge blocking property can be realized by reducing the amount of nitrogen in the interlayer, but the reduction of the amount of nitrogen in the interlayer is accompanied by a secondary hindrance, such as the increase of the residual electric potential of the photoreceptor. Accordingly, for practically using such a photoreceptor, it is required to reduce the thickness of the interlayer 0.1 μm or less. However, the reduction of the thickness of the interlayer brings direct contact of the photoconductive layer and the substrate, due to dusts attached onto the substrate upon production of the photoreceptor, in particular, dusts over 0.1 μm in diameter. The direct contact of the photoconductive layer and the substrate causes a partial injection of a charge into the photoconductive layer, which causes a defect of the device and also the defect of the image quality. Therefore, the problem of the dust gives large influences on the yield at the production of the photoreceptors.

SUMMARY OF THE INVENTION

An object of the present invention is, therefore, to provide a photoreceptor capable of simultaneously achieving the reduction of the charge blocking property, lowering of the residual electric potential, and the improvement of the yield for the photoreceptors by increasing the thickness of the interlayer together with the amount of nitrogen.

Other object of the present invention is to provide a negative-charging electrophotographic photoreceptor having a long life and a high reliability, and comprising high-sensitive amorphous silicon.

A further object of the present invention is to provide a negative-charging electrophotographic photoreceptor which is excellent in the electrostatic charging property, does not give a residual potential, is excellent in the repeating characteristics, and does not cause faint images even under any operating conditions.

A still other object of the present invention is to provide an electrophotographic process which does not generate ozone and has a high reliability and a high-speed adaptability for a long period of time.

Other objects and effects of the present invention will be apparent from the following description.

The present invention relates to a negative-charging electrophotographic photoreceptor comprising an electrically conductive support having consecutively thereon (a) a charge injection prevention layer having a thickness of from 0.15 to 10 μm, (b) a photoconductive layer, and (c) a surface layer, the charge injection prevention layer (a) comprising amorphous silicon containing at least one of a hydrogen atom and a halogen atom, and containing a nitrogen atom in an atomic ratio of from 0.01 to 0.65 to the silicon atom, the photoconductive layer (b) comprising amorphous silicon containing at least one of a hydrogen atom and a halogen atom.

The photoconductive layer (b) preferably contains an element belonging to the group III of the periodic table for controlling the electric conductivity thereof.

The photoconductive layer (b) also preferably comprises at least (b1) a layer comprising amorphous silicon and (b2) a layer comprising amorphous silicon/germanium.

The surface layer (c) preferably comprises amorphous silicon or amorphous carbon each containing at least one of a hydrogen atom and a halogen atom, and containing at least one selected from the group consisting of a nitrogen atom, a carbon atom, and an oxygen atom.

The surface layer (c) also preferably comprises amorphous silicon or amorphous carbon each containing an element belonging to the group III of the periodic table, containing at least one of a hydrogen atom and a halogen atom, and containing at least one selected from the group consisting of a nitrogen atom, a carbon atom, and an oxygen atom.

The surface layer (c) also preferably comprises consecutively on the photoconductive layer (b), (c1) a layer comprising amorphous silicon or amorphous carbon each containing an element belonging to the group III of the periodic table, containing at least one of a hydrogen atom and a halogen atom, and containing at least one selected from the group consisting of a nitrogen atom, a carbon atom, and an oxygen atom, and (c2) a layer comprising amorphous silicon or amorphous carbon each containing at least one selected from the group consisting of a carbon atom, a nitrogen atom, an oxygen atom, and an element belonging to the group V of the periodic table, and containing at least one of a hydrogen atom and a halogen atom.

The present invention also relates to an electrophotographic process comprising the steps of:

charging a surface of the above-described electrophotographic photoreceptor by contact charging;

exposing the surface of the electrophotographic photoreceptor to light to form an electrostatic latent image;

developing the electrostatic latent image to form a toner image;

transferring the toner image to a transfer material; and fixing the toner image thus transferred.

The present invention further relates to an electrophotographic process comprising the steps of:

charging a surface of the above-described electrophotographic photoreceptor;

exposing the surface of the electrophotographic photoreceptor to light to form an electrostatic latent image;

developing the electrostatic latent image to form a toner image; and fixing simultaneously with transferring the toner image to a transfer material by pressure.

DETAILED DESCRIPTION OF THE INVENTION

Figure 1:
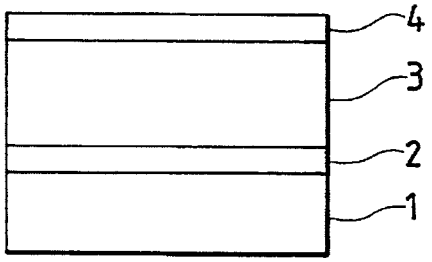
FIG. 1 is an enlarged schematic cross sectional view showing an example of the electrophotographic photoreceptor of the present invention.
Figure 2:
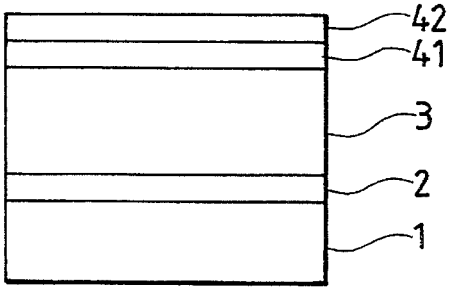
FIG. 2 is an enlarged schematic cross sectional view showing other example of the electrophotographic photoreceptor of the present invention.

FIG. 1 and FIG. 2 of the accompanied drawings each is an enlarged schematic cross sectional view showing examples of the electrophotographic photoreceptor of the present invention. In the example shown by FIG. 1, the electrophotographic photoreceptor according to the present invention comprises an electrically conductive support 1, a charge injection prevention layer 2 formed on the support, a photoconductive layer 3 formed on the layer 2, and a surface layer 4 formed on the layer 3. In the example shown by FIG. 2, the electrophotographic photoreceptor according to the present invention has the same constitution as that shown in FIG. 1 except that the surface layer has a laminated layer structure of a first surface layer 41 and a second surface layer 42.

Examples of the electrically conductive support include a metal such as aluminum, stainless steel, nickel, chromium, etc., the alloy thereof, and an insulating substrate subjected to an electrically conductive treatment. Examples of the insulating substrate include high molecular films or sheets of polyester, polyethylene, polycarbonate, polystyrene, polyamide, polyimide, etc., glass sheets, ceramic sheets, etc., and at least the surface of the film or sheet on which a photoconductive layer is provided is subjected to an electrically conductive treatment. The electrically conductive treatment can be practiced by applying the metal described above, or gold, silver, copper, etc., onto the surface of the film or sheet by a vapor deposition, sputtering, ion plating, etc.

Preferred examples of the electrically conductive support include a support comprising a Cr—Ni-containing steel generally called an austenite stainless steel and an electrically conductive support comprising such an austenite stainless steel having formed on the surface an electrically conductive layer comprising at least molybdenum, chromium, manganese, tungsten, and titanium as the main component. Such an electrically conductive layer can be formed by plating, sputtering, or a vapor deposition.

Other examples of the electrically conductive support include an aluminum base plate having formed thereon an electrically conductive layer comprising chromium, titanium, tungsten, or molybdenum as the main component. Furthermore, an electrically conductive support comprising molybdenum, tungsten, or titanium can be used.

The thickness of the electrically conductive support is generally from 0.5 to 50 mm, and preferably from 1 to 20 mm.

In the present invention, an electrically conductive support the surface of which is polished may be used. The surface of the electrically conductive support may be smoothened by repeatedly practicing buff polishing, grinding stone polishing, etc., while changing the particle sizes of the abrasives from rough particles to fine particles. The surface roughness is preferably in the range of from 2 to 0.02 S, and preferably from 0.5 to 0.03 S, as $R_s$. The surface may be completely mirror plane or may be blur by a honing treatment, and it necessary that the surface is smooth on the whole and in cutting by a lathe, convex portions are not left at the boundary of the cutting pitch.

The charge injection prevention layer formed on the electrically conductive support comprises amorphous silicon containing a hydrogen atom and/or a halogen atom and further containing a nitrogen atom at an atomic ratio of from 0.01 to 0.65, preferably from 0.3 to 0.65, more preferably from 0.4 to 0.65, to the silicon atom as an impurity element for controlling the electric conductivity. If the atomic ratio of a nitrogen atom to the silicon atom is less than 0.01, the charge blocking property to positive holes is insufficient and charging faculty is lowered. If the atomic ratio is higher than 0.65, the layer becomes insulating property, whereby the charges remain at the interface to generate residual potential and, thus, the repeating stability becomes poor.

The thickness of the charge injection prevention layer is in the range of from 0.15 μm to 5 μm.

The content of a hydrogen atom and/or a halogen atom in the charge injection prevention layer is generally from 5 to 30 atomic %, and preferably from 10 to 20 atomic %.

An auxiliary layer which functions as a adhesive layer may be provided between the charge injection prevention layer and the electrically conductive support. The auxiliary layer may comprise amorphous silicon containing at least one of nitrogen, carbon, or oxygen, and may have a thickness of from 0.01 to 5 μm, and preferably from 0.1 to 1 μm.

The photoconductive layer comprising amorphous silicon containing a hydrogen atom and/or a halogen atom. The content of a hydrogen atom and/or a halogen atom in the photoconductive layer is generally from 3 to 40 atomic %.

It is preferred that the photoconductive layer contains an element belonging to the group III of the periodic table as an impurity element for controlling the electric conductivity thereof. The addition amount of the element is determined by the necessary spectral sensitivity and is generally used in the range of from 0.01 ppm to 1,000 ppm.

To the photoconductive layer can be further added an element such as a nitrogen atom, a carbon atom, an oxygen atom, etc., for the purposes of the improvement of the electrostatic charging property, the reduction of the dark decay, the improvement of the sensitivity, etc. The amount and the distribution of the element are properly determined by the wavelength region to be used. For example, in the case of using short wavelength light, an n-type is preferred, and in the case of using long wavelength light, the addition elements are selected such that the distribution becomes an n-type, an i-type, and a p-type in this order from the surface.

The photoconductive layer may contain at least one of Ge and Sn.

It is preferred that the thickness of the photoconductive layer is in the range of from 1 to 100 μm.

The photoconductive layer may have a double layer structure comprising a charge generating layer and a charge transfer layer, and in this case, the charge generating layer may comprise amorphous silicon/germanium.

The surface layer formed on the photoconductive layer may comprise amorphous silicon or amorphous carbon each containing a hydrogen atom and/or a halogen atom and further containing at least one element selected from the group consisting of a nitrogen atom, a carbon atom, and an oxygen atom.

The content of a hydrogen atom and/or a halogen atom in the surface layer is preferably in the range of from 3 to 40 atomic % when the surface layer comprises amorphous silicon, and is preferably in the range of from 5 to 50 atomic % when the surface layer comprises amorphous carbon. When the surface layer comprises amorphous carbon, a large amount of a hydrogen atom or a halogen atom contained in the layer increases the amount of —$CH_2$— bond, —$CF_2$— bond, or —$CH_3$— bond in the form of chains in the layer, which results in reducing the hardness of the layer and hence the amount of the hydrogen atom or the halogen atom in the layer is preferably not more than 50 atomic %.

It is preferred that the surface layer contains at least one element selected from the group consisting of a nitrogen atom, a carbon atom, and an oxygen atom for controlling the trap density. The content of the element is generally from 1 ppm to 99.9 atomic % for a carbon atom, from 1 ppm to 60 atomic % for an oxygen atom, and from 1 ppm to 57 atomic % for a nitrogen atom.

The surface layer may contain an element belonging to the group III of the periodic table. The amount of the element of the group III is properly selected according to the thickness of the surface layer and preferably in the range of from 5 to 10,000 ppm.

The thickness of the surface layer is generally from 0.05 to 10 μm, and preferably from 0.1 to 5 μm.

In the present invention, the surface layer may be a double layer structure of a first surface layer, which is same as the surface layer described above, and a second surface layer formed on the first surface layer, as shown in FIG. 2.

The second surface layer comprises amorphous silicon or amorphous carbon containing at least one element selected from the group consisting of a carbon atom, a nitrogen atom, an oxygen atom, and an element belonging to the group V of the periodic table and further containing a hydrogen atom and/or a halogen atom.

The content of a hydrogen atom and/or a halogen atom in the second surface layer is preferably in the range of from 3 to 40 atomic % when the second surface layer comprises amorphous silicon, and is preferably in the range of from 5 to 50 atomic % when the second surface layer comprises amorphous carbon. The amount of the element of the group V in the second surface layer is preferably from 0.01 to 10,000 ppm.

The second surface layer may contain at least one element selected from the group consisting of a nitrogen atom, a carbon atom, and an oxygen atom for the purposes of controlling the charge injecting property and improving the surface hardness. The content of the element is generally in the range of from 1 ppm to 99.9 atomic % for a carbon atom, from 1 ppm to 60 atomic % for an oxygen atom, and from 1 ppm to 57 atomic % for a nitrogen atom.

The thickness of the second surface layer is generally from 0.01 to 10 μm, and preferably from 0.1 to 5 μm, and the thickness of the whole surface layers is preferably in the range of from 0.01 to 15 μm.

In the surface layer used in the present invention, the elements contained in the layer may be present with a concentration gradient in the thickness direction for the purposes of increasing the light absorption, reducing the residual potential, improving the electrostatic charging property, and reducing the dark decay.

The method of forming each of the foregoing layers on the electrically conductive support is described below.

Each of the layers formed on the electrically conductive support can be formed by a glow discharging decomposition method by a plasma CVD method, a sputtering method, an ion plating method, a vacuum vapor deposition method, etc., in which a gas containing a silicon atom or a gas containing a hydrocarbon or a halogen substitution product thereof is used as the raw material gas.

In the production method using the glow discharging decomposition method for example, as the raw material, a mixed gas of the foregoing raw material gas and a raw material gas for addition element(s) is used. If necessary, an inert gas such as hydrogen, helium, argon, neon, etc., can be used together as a carrier gas.

For the glow discharging decomposition, direct current discharging or alternating current discharging may be employed and as the film-forming conditions, the frequency is from 0 to 5 GHz, the inside pressure of the reaction vessel is from $10^{-5}$ to 10 Torr (0.001 to 1,333 Pa), and the discharging electric power is from 10 to 3,000 W. The temperature of the support can be properly selected in the range of from 30° to 400° C. The thickness of each layer can be properly controlled by controlling the discharging time.

In the case of forming the layer comprising amorphous silicon, as the main raw material gas containing a silicon atom, silanes, in particular, $SiH_4$ and/or $Si_2H_6$ is preferably used and as other raw material gas, $SiCl_4$, $SiHCl_3$, $SiH_2Cl_2$, $Si(CH_3)_4$, $Si_3H_8$, $Si_4H_{10}$, $SiF_4$, $SiHF_3$, $SiH_2F_2$, $SiH_3F$, etc., can also be used.

As the raw material gas for incorporating a nitrogen atom, an oxygen atom, or a carbon atom, for example, the following gas can be used. In the case of incorporating a nitrogen atom, an $N_2$ gas or a gas of a hydrogenated nitrogen compound such as $NH_3$, $H_2NNH_2$, $HN_3$, etc., can be used. In the case of incorporating a carbon atom, a hydrocarbon such as methane, ethane, propane, acetylene, etc., or a halogenated hydrocarbon such as $CF_4$, $C_2F_6$, etc., can be used. In the case of incorporating an oxygen atom, $)_2$, $N_2O$, CO, $CO_2$, etc., can be used.

As the raw material gas containing the element of the group III, diborane ($B_2H_6$) is generally used and as other raw material gases, $B_4H_{10}$, $BF_3$, $BCl_3$, etc., can be also used.

As the raw material gas containing the element of the group V, $PH_3$ is generally used and as other raw material gases, $P_2H_4$, $PF_3$, $PCl_3$, etc., can be also used.

In the case of forming the layer comprising amorphous silicon/germanium, a raw material for adding germanium is further used as the raw material. For example, $GeH_4$, $Ge_2H_6$, $Ge_3H_8$, $Ge_4H_{10}$, $Ge_5H_{12}$, $GeF_4$, $GeCl_4$, etc., can be used as the raw material gas.

In the case of forming the layer comprising amorphous carbon, the following raw materials can be used. Examples of the raw material for a carbon atom include aliphatic hydrocarbons, e.g., paraffinic hydrocarbons shown by the general formula $C_nH_{2n+2}$ such as methane, ethane, propane, butane, pentane, etc.; olefinic hydrocarbons shown by the general formula $C_nH_{2n}$ such as ethylene, propylene, butylene, pentene, etc.; and acetylene hydrocarbons shown by the general formula $C_nH_{2n-1}$ such as acetylene, allylene, butyne, etc.; alicyclic hydrocarbons such as cyclopropane, cyclobutane, cyclohexane, cycloheptane, cyclobutene, cyclopentene, cyclohexene, etc.; aromatic hydrocarbons such as benzene, toluene, xylene, naphthalene, anthracene, etc.; and the substitution products thereof. These hydrocarbon compounds may have a branched structure or may be halogen substituted products. For example, halogenated hydrocarbons such as carbon tetrachloride, chloroform, carbon tetrafluoride, trifluoromethane, chlorotrifluoromethane, dichlorodifluoromethane, bromotrifluoromethane, perfluoroethane, perfluoropropane, etc.

The raw materials for a carbon atom illustrated above may be in a gaseous state, a solid state, or a liquid state at normal temperature, and when the raw material is a solid or a liquid, it is used by being gasified.

The electrophotographic process of the present invention is described below.

Figure 3:
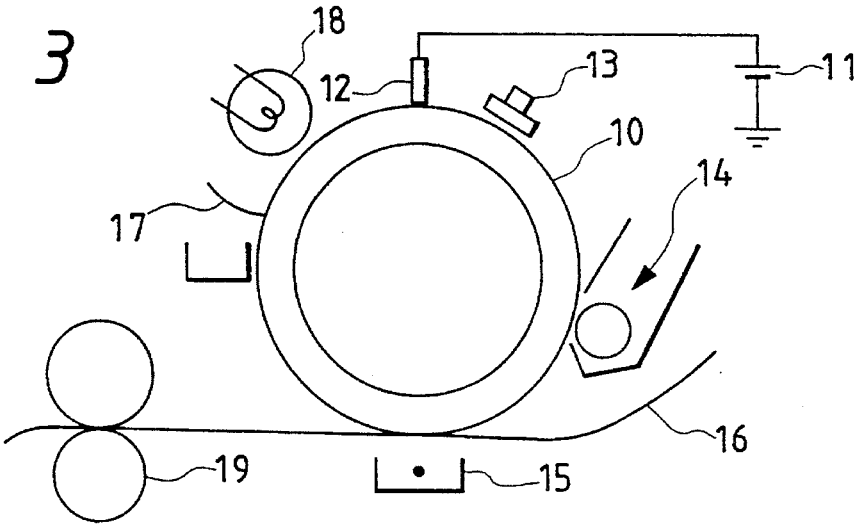
FIG. 3 is a view showing a schematic structure of an example of an electrophotographic copying machine for practicing the electrophotographic process of the present invention.

FIG. 3 is a schematic structural view showing an example of an electrophotographic copying machine for practicing the process of the present invention.

The surface of a photoreceptor of a photoreceptor drum 10 having the photoconductive layer and the surface layer described above is electrostatically charged by means of a contact-type charging device 12 applied with an electric voltage by an electric source 11. The charged surface of the photoreceptor is imagewise-exposed with light from an image input device 13 such as an original image through an optical system, laser, LED, etc., to form an electrostatic latent image. The electrostatic latent image formed is visualized (developed) using a toner by a developing means 14 to be converted into a toner image. As a developing method, a magnetic brush method can be used. The toner image formed is transferred onto paper 16 by press transferring or by means of an electrostatic transferring means 15. The toner remaining on the surface of the photoreceptor after transferring is removed by a cleaner means 17 using a blade and a small amount of charges remaining on the surface of the photoreceptor drum is removed by a charge eraser 18. The transferred toner image is fixed by a fixing means 19.

Figure 4:
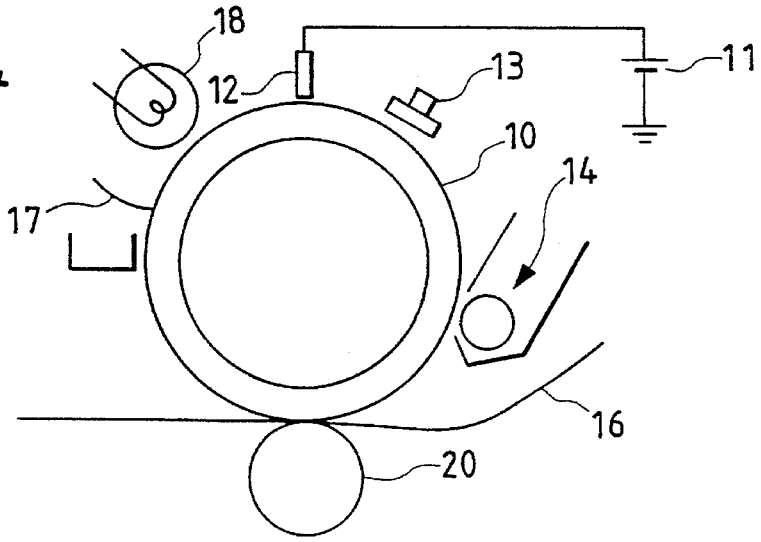
FIG. 4 is a view showing a schematic structure of other example of an electrophotographic copying machine for practicing the electrophotographic process of the present invention.

FIG. 4 is a schematic structural view of other example of an electrophotographic copying machine for practicing the process of the present invention. The copying machine has the same constitution as in FIG. 3 except that transferring and fixing are simultaneously carried out by applying pressure onto the surface of the photoreceptor drum 10 by means of a transfer fixing roll 20. This embodiment is advantageous in the points of simplifying and small-sizing the electrophotographic copying machine and reducing the energy required for the electrophotographic process.

Examples of the contact-type electrostatic charging device include various types such as a blade form, a roll form, etc. In the case of the blade form, various kinds of metals can be used. In these metals, aluminum, iron, nickel, stainless steel, tungsten, molybdenum, titanium, etc., can be preferably used.

Furthermore, the portion of the contact-type charging device, which is in contact with the surface of the photoreceptor, may be covered by amorphous silicon or amorphous carbon each containing at least one of a carbon atom, a nitrogen atom, an oxygen atom, an element belonging to the group III of the periodic table, and an element belonging to the group V and also containing a hydrogen atom and/or a halogen atom. In this case, even when the photoreceptor has pinholes, advantageous effects are obtained in that the occurrence of the deviation of the applied voltage caused by the pinholes is prevented, and the friction of the metal blade is reduced.

The contact-type electrostatic charging device is constructed such that an electric voltage can be applied from outside. The applied voltage employed is generally in the range of from 50 to 200 V and the electric current applied may be a superposed current of a direct current and an alternating current.

The present invention is described more practically by the following Examples and the Comparative Examples, but the present invention is not construed as being limited to the Examples. All parts, percents and the like are by weight unless otherwise indicated.

EXAMPLE 1

A cylindrical aluminum substrate having a thickness of 4 mm and a surface roughness $R_{max}$ of 0.05 μm was used as an electrically conductive support and an n-type charge injection prevention layer was formed on the electrically conductive support. The film-forming conditions for the charge injection prevention layer were as follows.

100% Silane gas flow rate: 25 $cm^3$/minute
100% Hydrogen gas flow rate: 180 $cm^3$/minute
100% Ammonia gas flow rate: 15 $cm^3$/minute
Reaction vessel inside pressure: 66.66 Pa (0.5 Torr)
Charging electric powder: 50 W
Discharging time: 30 minutes Discharging frequency: 13.56 MHz
Temperature of the support: 150° C.

In all the Examples and Comparative Examples described hereinafter, the charging frequency and the temperature of the support in the conditions of forming each layer by a plasma CVD method were fixed to the above-described values.

The atomic ratio of the nitrogen atom to the silicon atom of the charge injection prevention layer thus formed measured by an X-ray photoelectron spectroscopy was 0.6.

After forming the charge injection prevention layer, the inside of the reaction vessel was sufficiently evacuated and a mixture of a silane gas, a hydrogen gas, and a diborane gas was introduced into the reaction vessel followed by carrying out a glow discharging decomposition, whereby a photoconductive layer having a thickness of about 20 μm was formed on the charge injection prevention layer. The conditions of forming the photoconductive layer were as follows.

100% Silane gas flow rate: 180 $cm^3$/minute
100% Hydrogen gas flow rate: 162 $cm^3$/minute
2 ppm Hydrogen-diluted diborane gas flow rate: 18 $cm^3$/min.
Reaction vessel inside pressure: 133.32 Pa (1.0 Torr)
Discharging electric power: 300 W
Discharging time: 200 minutes After forming the photoconductive layer, the inside of the reaction vessel was sufficiently evacuated and then a mixture of a silane gas, a diborane gas, and an ethylene gas was introduced into the reaction vessel followed by carrying out a glow discharging decomposition, whereby a surface layer having a thickness of about 1 μm was formed on the photoconductive layer. The conditions of forming the surface layer were as follows.

100% Silane gas flow rate: 180 $cm^3$/minute
100% Ethylene gas flow rate: 180 $cm^3$/minute
200 ppm Hydrogen-diluted diborane gas flow rate: 180 $cm^3$/minute
Reaction vessel inside pressure: 133.32 Pa (1.0 Torr)
Discharging electric power: 200 W
Discharging time: 10 minutes

EXAMPLE 2 AND COMPARATIVE EXAMPLES 1 AND 2

Using the substrate same as in Example 1, an electrophotographic photoreceptor having the same layer structure as in Example 1 was prepared, except that upon forming the charge injection prevention layer, the composition of the raw material gases was changed as shown in Table 1 below and each electrophotographic photoreceptor having the atomic ratio (N/Si) of the nitrogen atom to the silicon atom was prepared.

The electrostatic charging characteristics of each electrophotographic photoreceptor prepared were measured, and the results shown in Table 1 below were obtained. A tungsten lamp was used for the image exposure. The measurement results of Example 1 were shown in Table 1.

TABLE 1

| | Raw material gas composition | | | | Layer | Charging | Residual |
|---|---|---|---|---|---|---|---|
| | Silane ($cm^3$/min) | Ammonia ($cm^3$/min) | Hydrogen ($cm^3$/min) | N/Si ratio | thickness (μm) | potential (V) | potential (V) |
| Example 1 | 25 | 15 | 180 | 0.6 | 1.0 | 500 | 10 |
| Example 2 | 39 | 1 | 180 | 0.015 | 1.5 | 300 | 5 |
| Comparative Example 1 | 39.5 | 0.5 | 180 | 0.005 | 1.5 | 100 | 5 |
| Comparative Example 2 | 10 | 30 | 180 | 0.8 | 0.5 | 500 | 100 |

As is clear from the results shown in Table 1, in Comparative Example 1, since the charge injection prevention property is insufficient, the electrostatic charging property is low, and in Comparative Example 2, the insulating property of the charge injection prevention layer is increased, which results in increasing the residual potential.

EXAMPLE 3

After forming the charge injection prevention layer, the photoconductive layer, and the surface layer as in Example 2, the surface layer was used as a first surface layer and a second surface layer was formed in the following manner on the first surface layer. A mixture of a silane gas, a hydrogen gas, and an ammonia gas was introduced into the reaction vessel and a glow discharging decomposition was carried out, whereby the second surface layer having a thickness of 1.0 μm was formed on the first surface layer. The conditions of forming the second surface layer were as follows.

100% Silane gas flow rate: 40 $cm^3$/minute
100% Hydrogen gas flow rate: 180 $cm^3$/minute
100% Ammonia gas flow rate: 20 $cm^3$/minute
Reaction vessel inside pressure: 66.66 Pa (0.5 Torr).
Discharging electric power: 50 W
Discharging time: 30 minutes An imaging test was carried out using the electrophotographic photoreceptor by a copying machine (Vivace 500, trade name, manufactured by Fuji Xerox Co., Ltd.). The images obtained were clear and no fog was observed.

EXAMPLE 4

The electrophotographic photoreceptor prepared in Example 3 was mounted in each of the printers each having the structure shown in FIGS. 3 or 4 described above and images were formed at a speed of 40 sheets per minute. An iron blade was used as the contact-type electrostatic charging device, and a voltage of −400 V was applied. As the result of the imaging test of 10,000 sheets, attaching of the toner and additives on the surface of the photoreceptor was not observed, electrostatic charging was stable, and the images obtained were clear, in the case of using each printer.

EXAMPLE 5

Using the substrate same as in Example 1, an electrophotographic photoreceptor having the same layer structure as in Example 1 was prepared, except that upon forming the charge injection prevention layer, the composition of the raw material gases was changed as shown in Table 2 below and each electrophotographic photoreceptor having the charge injection prevention layer having the atomic ratio (N/Si) of the nitrogen atom to the silicon atom was prepared. The charging characteristics of each electrophotographic photoreceptor prepared were measured, and the results shown in Table 2 below were obtained. A tungsten lamp was used for the image exposure.

TABLE 2

| | | Layer thickness (μm) | | |
|---|---|---|---|---|
| Sample No. | N/Si ratio | 0.1 | 0.15 | 0.5 |
| 1 | 0.7 | C1 | C1 | C1 |
| 2 | 0.65 | C2 | A | A |
| 3 | 0.6 | C2 | B | A |
| 4 | 0.015 | C2 | B | A |

Note:
A: Excellent
B: Practically usable
C1: The residual potential was high and fogged or low-density images formed.
C2: The charging potential was high and low-density or fogged images formed, and white or black spots formed.

EXAMPLE 6

After forming the charge injection prevention layer, the photoconductive layer, and the surface layer as in Example 2, the surface layer was used as a first surface layer and a second surface layer was formed in the following manner on the first surface layer. A mixture of a hydrogen gas and an ethylene gas was introduced into the reaction vessel and a glow discharging decomposition was carried out, whereby the second surface layer having a thickness of 0.1 μm was formed on the first surface layer. The conditions of forming the second surface layer were as follows.

100% Hydrogen gas flow rate: 160 $cm^3$/min
100% Ethylene gas flow rate: 40 $cm^3$/min
Reaction vessel inside pressure: 40 Pa (0.3 Torr)
Discharging electric power: 400 W
Discharging time: 30 minutes An imaging test was carried out using the electrophotographic photoreceptor by a copying machine (Vivace 500, trade name, manufactured by Fuji Xerox Co., Ltd.). The images obtained were clear and no fog was observed.

Since the electrophotographic photoreceptor of the present invention has the construction described above, the photoreceptor is used as a negative-charging type photoreceptor, the photoreceptor is excellent in the electrostatic charging property, does not give a residual potential, and is excellent in the repeating characteristics, as well as the photoreceptor does not cause faint images under any operation conditions. The electrophotographic photoreceptor of the present invention also has a long life, a high reliability, and a high sensitivity, thereby the photoreceptor is very suitable as a photoreceptor for an electrophotographic photoreceptor using a contact-type electrostatic charging device.

In the present invention, even in the case that the thickness of the charge injection prevention layer is thinner than 0.1 μm, images having no image defects such as white spots or black spots caused by the unevenness of the base plate of the photoreceptor and dusts, having no fog, and having a high density can be obtained.

Furthermore, the electrophotographic process of the present invention gives the effects of not generating ozone and having a high reliability and a high speed adaptability for a long period of time.

While the invention has been described in detail and with reference to specific examples thereof, it will be apparent to one skilled in the art that various changes and modifications can be made therein without departing from the spirit and scope thereof.

What is claimed is:

1. A negative-charging electrophotographic photoreceptor comprising an electrically conductive support having consecutively thereon (a) a charge injection prevention layer having a thickness of from 0.15 to 10 μm, (b) a photoconductive layer, and (c) a surface layer, said charge injection prevention layer (a) comprising amorphous silicon containing at least one of a hydrogen atom and a halogen atom, and containing a nitrogen atom in an atomic ratio of from 0.01 to 0.65 to the silicon atom, said photoconductive layer (b) comprising amorphous silicon containing at least one of a hydrogen atom and a halogen atom.

2. A negative-charging electrophotographic photoreceptor of claim 1, wherein said photoconductive layer (b) contains an element belonging to the group III of the periodic table for controlling the electric conductivity thereof.

3. A negative-charging electrophotographic photoreceptor of claim 1, wherein said photoconductive layer (b) comprises at least (b1) a layer comprising amorphous silicon and (b2) a layer comprising amorphous silicon/germanium.

4. A negative-charging electrophotographic photoreceptor of claim 1, wherein said surface layer (c) comprises amorphous silicon or amorphous carbon each containing at least one of a hydrogen atom and a halogen atom, and containing at least one selected from the group consisting of a nitrogen atom, a carbon atom, and an oxygen atom.

5. A negative-charging electrophotographic photoreceptor of claim 1, wherein said surface layer (c) comprises amorphous silicon or amorphous carbon each containing an element belonging to the group III of the periodic table, containing at least one of a hydrogen atom and a halogen atom, and containing at least one selected from the group consisting of a nitrogen atom, a carbon atom, and an oxygen atom.

6. A negative-charging electrophotographic photoreceptor of claim 1, wherein said surface layer (c) comprises consecutively on said photoconductive layer (b), (c1) a layer comprising amorphous silicon or amorphous carbon each containing an element belonging to the group III of the periodic table, containing at least one of a hydrogen atom and a halogen atom, and containing at least one selected from the group consisting of a nitrogen atom, a carbon atom, and an oxygen atom, and (c2) a layer comprising amorphous silicon or amorphous carbon each containing at least one selected from the group consisting of a carbon atom, a nitrogen atom, an oxygen atom, and an element belonging to the group V of the periodic table, and containing at least one of a hydrogen atom and a halogen atom.

7. An electrophotographic process comprising the steps of:

charging a surface of a electrophotographic photoreceptor by contact charging;

exposing said surface of said electrophotographic photoreceptor to light to form an electrostatic latent image;

developing said electrostatic latent image to form a toner image;

transferring said toner image to a transfer material; and fixing said toner image thus transferred, said electrophotographic photoreceptor comprising an electrically conductive support having consecutively thereon (a) a charge injection prevention layer having a thickness of from 0.15 to 10 μm, (b) a photoconductive layer, and (c) a surface layer, said charge injection prevention layer (a) comprising amorphous silicon containing at least one of a hydrogen atom and a halogen atom, and containing a nitrogen atom in an atomic ratio of from 0.01 to 0.65 to the silicon atom, said photoconductive layer (b) comprising amorphous silicon containing at least one of a hydrogen atom and a halogen atom.

8. An electrophotographic process comprising the steps of:

charging a surface of a electrophotographic photoreceptor;

exposing said surface of said electrophotographic photoreceptor to light to form an electrostatic latent image;

developing said electrostatic latent image to form a toner image; and fixing simultaneously with transferring said toner image to a transfer material by pressure, said electrophotographic photoreceptor comprising an electrically conductive support having consecutively thereon (a) a charge injection prevention layer having a thickness of from 0.15 to 10 μm, (b) a photoconductive layer, and (c) a surface layer, said charge injection prevention layer (a) comprising amorphous silicon containing at least one of a hydrogen atom and a halogen atom, and containing a nitrogen atom in an atomic ratio of from 0.01 to 0.65 to the silicon atom, said photoconductive layer (b) comprising amorphous silicon containing at least one of a hydrogen atom and a halogen atom.

* * * * *